US007602122B2

(12) United States Patent
Kyushima et al.

(10) Patent No.: US 7,602,122 B2
(45) Date of Patent: Oct. 13, 2009

(54) PHOTOMULTIPLIER

(75) Inventors: Hiroyuki Kyushima, Hamamatsu (JP); Hideki Shimoi, Hamamatsu (JP); Akihiro Kageyama, Hamamatsu (JP); Keisuke Inoue, Hamamatsu (JP); Masuo Ito, Hamamatsu (JP)

(73) Assignee: Hamamatsu Photonics K.K., Hamamatsu-shi, Shizuoka (JP)

( * ) Notice: Subject to any disclaimer, the term of this patent is extended or adjusted under 35 U.S.C. 154(b) by 249 days.

(21) Appl. No.: 10/586,498

(22) PCT Filed: Feb. 16, 2005

(86) PCT No.: PCT/JP2005/002302

§ 371 (c)(1),
(2), (4) Date: Jul. 20, 2006

(87) PCT Pub. No.: WO2005/078759

PCT Pub. Date: Aug. 25, 2005

(65) Prior Publication Data

US 2008/0018246 A1 Jan. 24, 2008

(30) Foreign Application Priority Data

Feb. 17, 2004 (JP) ..... 2004-040405

(51) Int. Cl.
*H01J 43/04* (2006.01)

(52) U.S. Cl. ..... 313/532; 313/105 CM

(58) Field of Classification Search ..... 313/532–535, 313/542, 103 R, 105 CM
See application file for complete search history.

(56) References Cited

U.S. PATENT DOCUMENTS

| | | | | |
|---|---|---|---|---|
| 3,225,239 | A | 12/1965 | Thompson | |
| 3,244,922 | A | 4/1966 | Wolfgang | |
| 3,374,380 | A | 3/1968 | Goodrich | |
| 3,375,184 | A | 3/1968 | Giacopelli | |
| 3,563,657 | A | 2/1971 | Knisley et al. | |
| 3,573,464 | A | 4/1971 | Miya | |
| 3,883,335 | A | 5/1975 | Polaert | |
| 5,264,693 | A | 11/1993 | Shimabukuro et al. | |
| 5,329,110 | A | 7/1994 | Shimabukuro et al. | |
| 5,493,111 | A * | 2/1996 | Wheeler et al. | 250/207 |
| 5,568,013 | A | 10/1996 | Then et al. | 313/532 |

(Continued)

FOREIGN PATENT DOCUMENTS

| | | |
|---|---|---|
| JP | S50-16145 | 6/1975 |

(Continued)

*Primary Examiner*—Vip Patel
(74) *Attorney, Agent, or Firm*—Drinker Biddle & Reath LLP

(57) ABSTRACT

The present invention relates to a photomultiplier of a fine structure that realizes a high multiplier efficiency. The photomultiplier comprises an outer casing whose interior is maintained at vacuum, and, in the outer case, a photocathode that emits photoelectrons in response to incident light, an electron multiplier section that performs cascade multiplication of the photoelectrons emitted from the photocathode, and an anode for taking out secondary electrons, which are generated at the electron multiplier section, are arranged. In particular, groove portions for performing cascade multiplication of electrons from the photocathode are provided in the electron multiplier section, and on the respective surfaces of each pair of wall portions that define the groove portions are provided with one or more protrusions each having a secondary electron emitting surface formed on the surface thereof.

5 Claims, 10 Drawing Sheets

U.S. PATENT DOCUMENTS

| | | | | |
|---|---|---|---|---|
| 6,989,632 | B2 * | 1/2006 | Bach et al. | 313/533 |
| 7,049,747 | B1 | 5/2006 | Goodberlet et al. | |
| 7,294,954 | B2 | 11/2007 | Syms | |

FOREIGN PATENT DOCUMENTS

| | | |
|---|---|---|
| JP | 4-359855 | 12/1992 |
| JP | 5144410 | 6/1993 |
| JP | 2000-040487 | 2/2000 |
| JP | 2000-113851 | 4/2000 |
| JP | 3078905 | 6/2000 |

* cited by examiner (a)

(b)

PHOTOMULTIPLIER

TECHNICAL FIELD

The present invention relates to a photomultiplier that performs cascade multiplication of photoelectrons generated by a photocathode.

BACKGROUND ART

Photomultiplier tubes (PMTs) have been known as photosensors since previously. The photomultiplier comprises a photocathode that converts light into electrons, a focusing electrode, an electron multiplier section, and an anode, and these components are accommodated in a vacuum container. In the photomultiplier, when light is made incident on the photocathode, photoelectrons are emitted from the photocathode into the vacuum container. The photoelectrons are guided by the focusing electrode to the electron multiplier section and cascade multiplied by the electron multiplier section. The anode outputs, as signals, those electrons, among the multiplied electrons, that have reached (see for example Patent Document 1 and Patent Document 2 described below).

Patent Document 1: Japanese Patent Publication No. 3078905

Patent Document 2: Japanese Patent Application Laid-Open No. Hei-4-359855

DISCLOSURE OF THE INVENTION

Problem to be Solved by the Invention

The inventors have studied conventional photomultipliers in detail, and as a result, have found problems as follows.

That is, in the diversification of applications of photosensors, photomultipliers that are more compact are being demanded. With the making of photomultipliers compact, processing arts of high precision are becoming demanded of parts that make up photomultipliers. In particular, since as the parts themselves become finer, precise alignment among the parts becomes difficult to realize, the scattering of the detection precision among manufactured photomultipliers becomes large.

In order to overcome the above-mentioned problems, it is an object of the present invention to provide a photomultiplier of fine structure that enables a higher multiplier efficiency to be obtained.

Means for Solving Problem

A photomultiplier according to the present invention is a photo-sensor having an electron multiplier section, performing cascade multiplication of electrons generated by a photocathode, and is arranged, in accordance with the position of the photocathode, as a photomultiplier with a transmission type photocathode that emits photoelectrons in the same direction as a direction of incidence of light, or as a photomultiplier with a reflecting photocathode that emits photoelectrons in a direction that differs from the direction of incidence of light.

Specifically, the photomultiplier comprises an outer casing whose interior is maintained in a vacuum state, a photocathode accommodated in the outer casing, an electron multiplier section accommodated in the outer casing, and an anode having at least a portion accommodated in the outer casing. The outer casing is constituted by a lower frame comprised of a glass material, a side wall frame, on which the electron multiplier section and the anode are integrally etch-processed, and an upper frame comprised of a glass material or a silicon material.

The photomultiplier has groove portions or through holes that extend along a propagation direction of the electrons. Each groove portion is defined by a pair of wall portions that have been finely processed by an etching technique. In particular, on each surface of the pair of wall portions that define a groove portion, one or more protrusions each having a secondary electron emitting surface formed on its surface to perform cascade multiplication of the photoelectrons from the photocathode, are disposed along the propagation direction of the electrons. Since by the protrusions thus being disposed on wall portion surfaces on which secondary electron emitting surfaces are provided, the possibility that electrons proceeding toward the anode will collide with the wall portions is significantly increased, an adequate electron multiplication factor is obtained even with a fine structure. Realistically speaking, the secondary electron emitting surfaces are formed not just on the surfaces of the protrusions but on the entire surfaces of the wall portions including the surfaces of the protrusions.

In the photomultiplier according to the present invention, the protrusions provided on the surface of one of the wall portions among the pair of wall portions and the protrusions provided on the surface of the other wall portion are preferably positioned alternately along the propagation direction of the electrons from the photocathode. By this arrangement, the possibility that the electrons from the photocathode will collide with at least one of the wall portions is increased.

More specifically, a height B of each protrusion provided on the surface of the one wall portions among the pair of wall portions preferably satisfies, with respect to an interval A between the pair of wall portions, the relationship, $B \geqq A/2$. This is because, by the protrusions respectively provided on the pair of wall portion surfaces satisfying this relationship, the electrons proceeding along the groove portion toward the anode are prevented from taking a rectilinear path and thus the electrons proceeding toward the anode reliably contribute to the improvement of the secondary electron multiplication factor by colliding at least once with either of the pair of wall portions.

On the other hand, in the case where the photomultiplier has a through hole, this through hole is defined by wall portions that are finely processed by an etching technique. On a surface of each wall portion that defines this through hole, one or more protrusions, each having a secondary electron emitting surface formed on its surface to perform cascade multiplication of the photoelectrons from the photocathode, are formed. Since by the protrusions thus being disposed on wall portion surfaces on which secondary electron emitting surfaces are formed, the possibility that electrons proceeding toward the anode will collide with the wall portions is dramatically increased, an adequate electron multiplication factor is obtained even with a fine structure. Realistically speaking, the secondary electron emitting surfaces are formed not just on the surfaces of the protrusions but on the entire surfaces of the wall portions including the surfaces of the protrusions.

The present invention will be more fully understood from the detailed description given hereinbelow and the accompanying drawings, which are given by way of illustration only and are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will be apparent to those skilled in the art from this detailed description.

Effect of the Invention

In accordance with the present invention, in each groove portion, extending along an interval through which the photoelectrons emitted from the photocathode proceed toward the anode, one or more protrusions are provided on the respective surfaces of the pair of wall portions that define the groove portion, therefore the probability of collision of electrons with the pair of wall portions is dramatically increased and the secondary electron multiplier efficiency of the secondary electron emitting surfaces formed on the wall portion surfaces is dramatically improved.

DESCRIPTION OF THE REFERENCE NUMERALS

1*a* . . . photomultiplier; 2 . . . upper frame; 3 . . . side wall frame; 4 . . . lower frame (glass substrate); 22 . . . photocathode surface; 31 . . . electron multiplier section; 32 . . . anode; and 42 . . . anode terminal.

BEST MODES FOR CARRYING OUT THE INVENTION

In the following, embodiments of a photomultiplier according to the present invention will be explained in detail with reference to FIGS. 1 to 10. In the explanation of the drawings, constituents identical to each other will be referred to with numerals identical to each other without repeating their overlapping descriptions.

Figure 1:
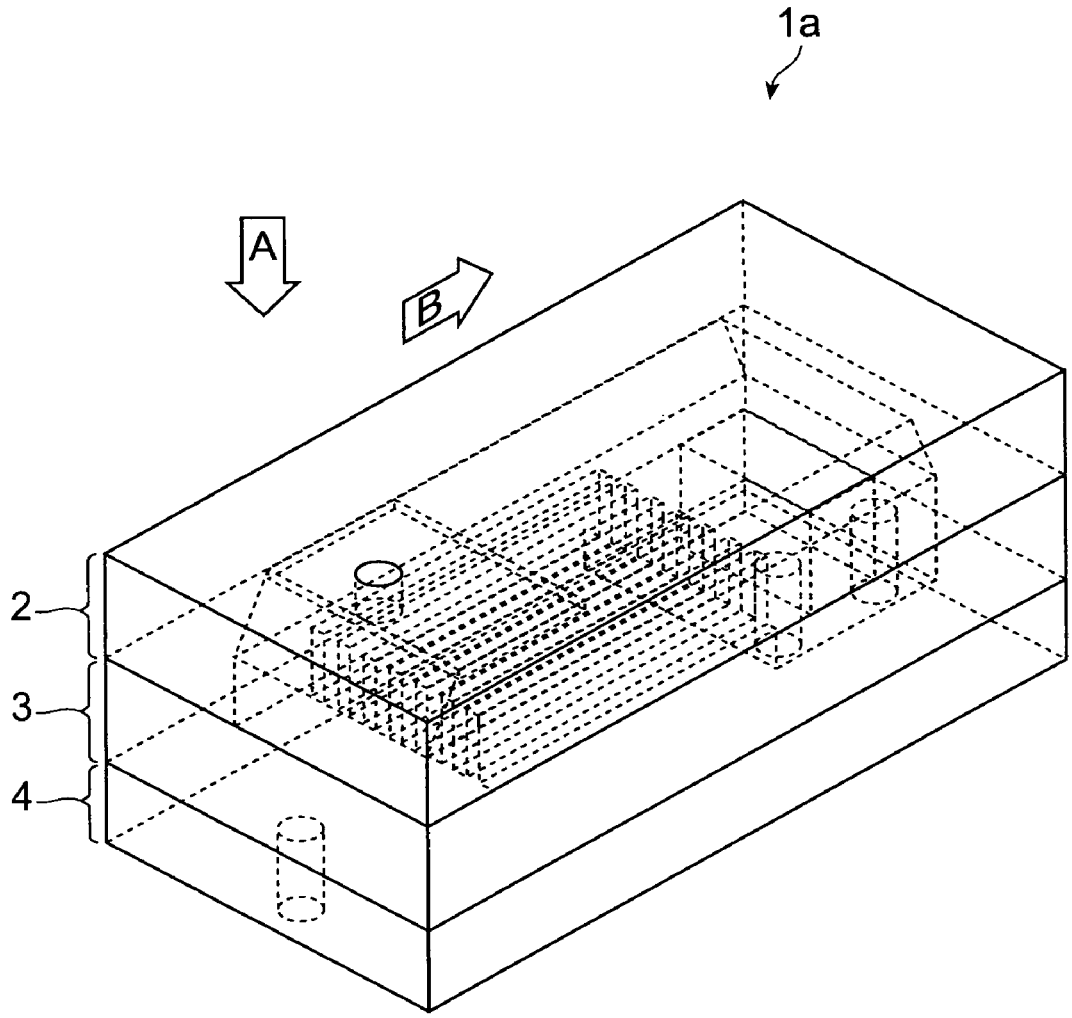
FIG. 1 is a perspective view of an arrangement of one embodiment of a photomultiplier according to the present invention.

FIG. 1 is a perspective view of an arrangement of one embodiment of a photomultiplier according to the present invention. The photomultiplier 1*a* shown in FIG. 1 is a transmission type electron multiplier, and has an outer casing constituted by an upper frame 2 (glass substrate), a side wall frame 3 (silicon substrate), and a lower frame 4 (glass substrate). In this photomultiplier 1*a*, an incident direction of light onto a photocathode and a propagation direction of electrons in an electron multiplier section intersect. That is, this is a photomultiplier in which, when light is made incident from the direction indicated by arrow A in FIG. 1, photoelectrons emitted from the photocathode are made to enter the electron multiplier section, and by the photoelectrons progressing in the direction indicated by arrow B, secondary electrons are cascade multiplied. The respective components shall now be explained.

Figure 2:
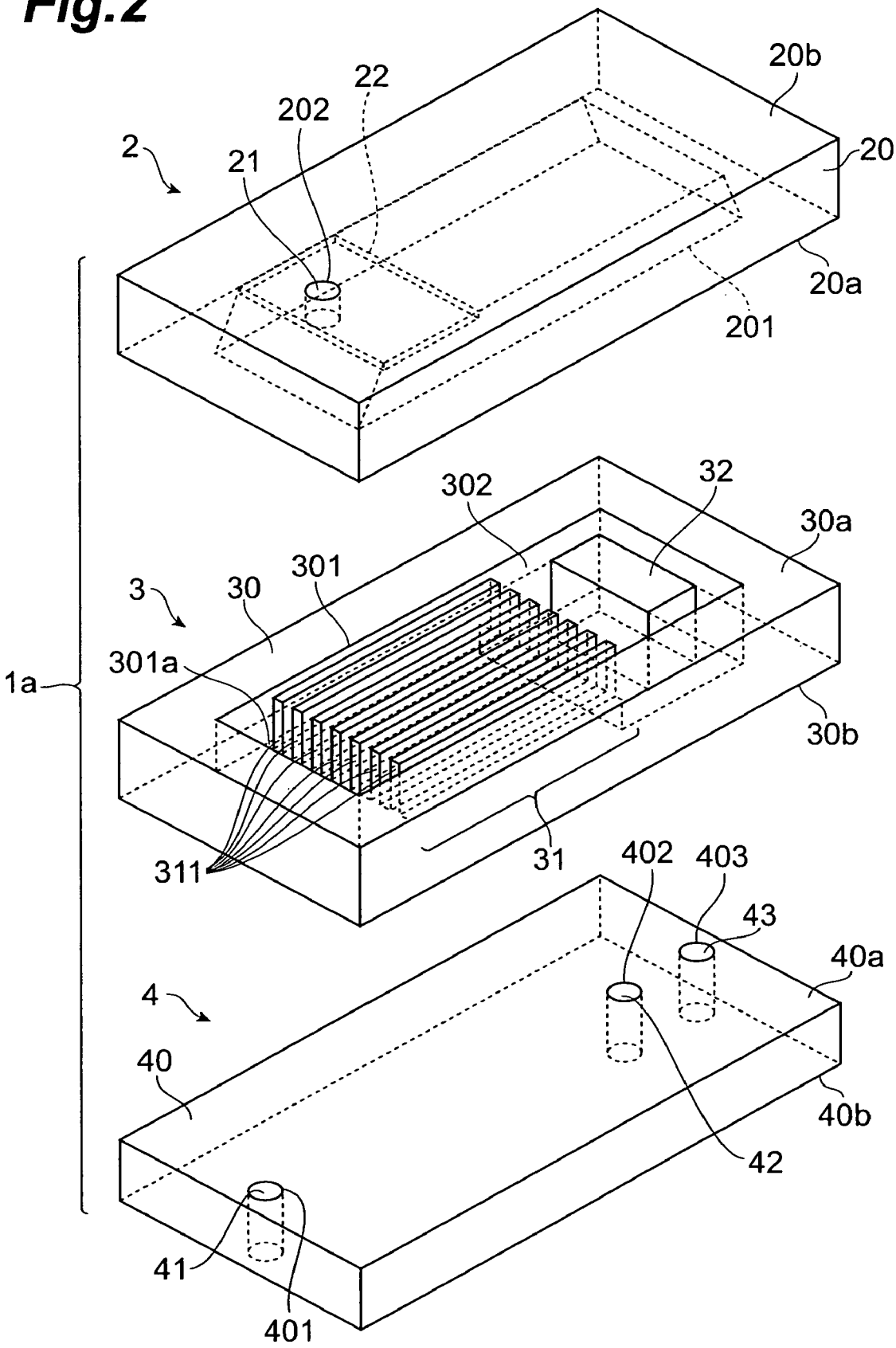
FIG. 2 is an assembly process diagram of the photomultiplier shown in FIG. 1.

FIG. 2 is a perspective view of the photomultiplier 1*a*, shown in FIG. 1, as exploded into the upper frame 2, side wall frame 3, and lower frame 4. The upper frame 2 is constituted by a glass substrate 20 with a rectangular plate-like form as a base material. A rectangular recessed portion 201 is formed on a principal surface 20*a* of the glass substrate 20, and the outer periphery of the recessed portion 201 is formed parallel to the outer periphery of the glass substrate 20. A photocathode 22 is formed at a bottom portion of the recessed portion 201. The photocathode 22 is formed near one end in the longitudinal direction of the recessed portion 201. A hole 202 is formed in a surface 20*b* at the side opposite the principal surface 20*a* of the glass substrate 20, and the hole 202 reaches the photocathode 22. A photocathode terminal 21 is disposed inside the hole 202 and this photocathode terminal 21 contacts the photocathode 22. In this first embodiment, the upper frame 2, which is formed of glass material, functions in itself as a transmitting window.

Side wall frame 3 is constituted by a silicon substrate 30 with a rectangular plate-like form as a base material. A recessed portion 301 and a pass-through portion 302 are formed from a principal surface 30*a* of the silicon substrate 30 toward a surface 30*b* at the opposite side. The recessed portion 301 and the pass-through portion 302 both have rectangular openings, the recessed portion 301 and the pass-through portion 302 are connected to each other, and the outer peripheries thereof are formed parallel to the outer periphery of the silicon substrate 30.

An electron multiplier section 31 is formed inside recessed portion 301. The electron multiplier section 31 has a plurality of wall portions 311 that are erected parallel to each other from a bottom portion 301*a* of the recessed portion 301. Groove portions are thus arranged respectively between the wall portions 311. Secondary electron emitting surfaces are formed of a secondary electron emitting material on side walls of the wall portions 311 (side walls defining the respective groove portions) and on the bottom portion 301*a*. Each wall portion 311 is disposed along the longitudinal direction of the recessed portion 301 with one end thereof being spaced by a predetermined distance from one end of the recessed portion 301 and the other end being positioned at a position facing the pass-through portion 302. An anode 32 is disposed inside the pass-through portion 302. The anode 32 is positioned with spaces being provided with respect to the inner walls of the pass-through portion 302 and is fixed to the lower frame 4 by anodic bonding or diffusion bonding.

Lower frame 4 is constituted by a glass substrate 40 with a rectangular plate-like form as a base material. A hole 401, a hole 402, and a hole 403 are formed from a principal surface 40*a* of the glass substrate 40 toward an opposing surface 40*b*. A photocathode side terminal 41 is inserted and fixed in hole 401, an anode terminal 42 is inserted and fixed in the hole 402, and an anode side terminal 43 is inserted and fixed in the hole 403. The anode terminal 42 contacts the anode 32 of the side wall frame 3.

Figure 3:
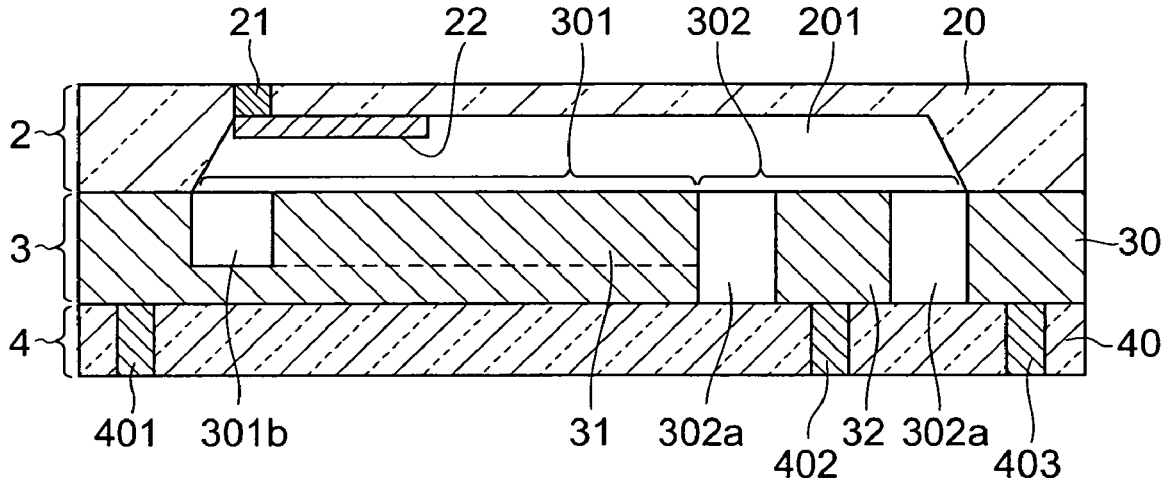
FIG. 3 is a sectional view of the photomultiplier structure taken along line I-I of FIG. 1.

FIG. 3 is a sectional view of the structure of the photomultiplier 1*a* taken along line I-I of FIG. 1. As described above, the photocathode 22 is formed on a bottom portion at one end of the recessed portion 201 of the upper frame 2. The photocathode 22 is in contact with the photocathode terminal 21 and a predetermined voltage is applied through the photocathode terminal 21 to the photocathode 22. The upper frame 2 is fixed to the side wall frame 3 by the principal surface 20*a* of the upper frame 2 (see FIG. 2) being joined by anodic bonding or diffusion bonding to the principal surface 30*a* of the side wall frame 3 (see FIG. 2).

At positions corresponding to the recessed portion 201 of the upper frame 2, the recessed portion 301 and the pass-through portion 302 of the side wall frame 3 are arranged. The electron multiplier section 31 is positioned in the recessed portion 301 of the side wall frame 3 and a gap 301*b* is formed between the wall at one end of the recessed portion 301 and the electron multiplier section 31. In this case, the electron multiplier section 31 of the side wall frame 3 is directly positioned below the photocathode 22 of the upper frame 2. The anode 32 is positioned in the pass-through portion 302 of the side wall frame 3. Since the anode 32 is positioned so as not to contact the inner walls of the pass-through portion 302, a gap 302*b* is formed between the anode 32 and the pass-through portion 302. The anode 32 is fixed to the principal surface 40*a* of the lower frame 4 (see FIG. 2) by anodic bonding or diffusion bonding.

The lower frame 4 is fixed to the side wall frame 3 by the surface 30*b* of side wall frame 3 (see FIG. 2) being joined by anodic bonding or diffusion bonding to the principal surface 40*a* of the lower frame 4 (see FIG. 2). At the same time, the electron multiplier section 31 of the side wall frame 3 is fixed by anodic bonding or diffusion bonding to the lower frame 4. By the upper frame 2 and the lower frame 4, respectively comprised of glass material, sandwiching the side wall frame 3 and being respectively bonded to the side wall frame, an outer casing of the photomultiplier 1*a* is obtained. A space is formed in the interior of this outer casing, and in the process of assembling the outer casing arranged from the upper frame 2, side wall frame 3, and lower frame 4, a vacuum sealing process is performed and the interior of the outer casing is maintained in a vacuum state (details shall be given below).

Since the photocathode side terminal 401 and the anode side terminal 403 of the lower frame 4 respectively contact the silicon substrate 30 of the side wall frame 3, a potential difference can be made to arise in the longitudinal direction (a direction intersecting a direction in which photoelectrons are emitted from the photocathode 22; the direction in which secondary electrons propagate through electron multiplier section 31) of the silicon substrate 30 by applying predetermined voltages to the photocathode side terminal 401 and the anode side terminal 403. Since the anode terminal 402 of the lower frame 4 contacts the anode 32 of the side wall frame 3, electrons arriving at the anode 32 can be taken out as signals.

Figure 4:
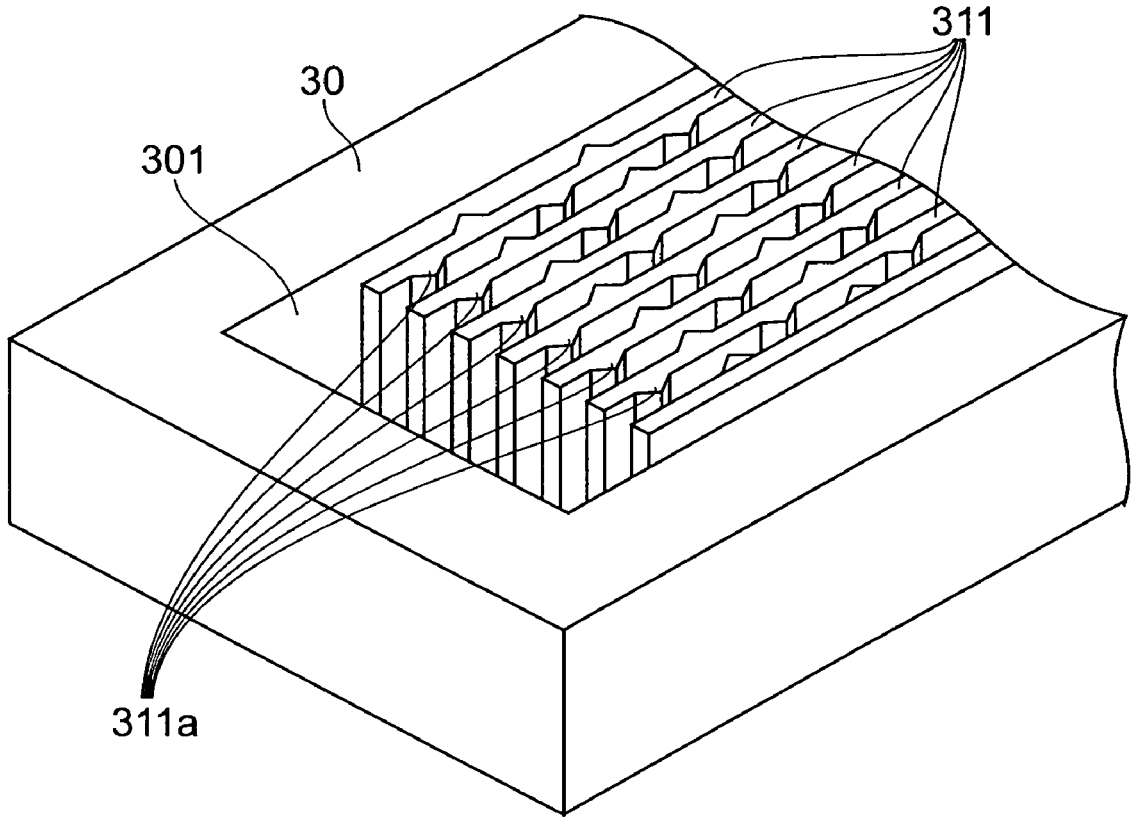
FIG. 4 is a perspective view of a structure of an electron multiplier section of the photomultiplier shown in FIG. 1.

FIG. 4 shows the structure near the wall portions 311 of the side wall frame 3. The protrusions 311*a* are formed on the side walls of wall portions 311 disposed inside the recessed portion 301 of the silicon substrate 30. The protrusions 311*a* are alternately positioned so that those of the opposing wall portions 311 are staggered with respect to each other. The protrusions 311*a* are uniformly formed from an upper end to a lower end of each wall portion 311.

The photomultiplier 1*a* operates as follows. That is, −2000V is applied to the photocathode side terminal 401 of the lower frame 4 and 0V is applied to the anode side terminal 403. The resistance of the silicon substrate 30 is approximately 10 MΩ. The resistance of the silicon substrate 30 can be adjusted by changing the volume, that is, for example, the thickness of the silicon substrate 30. For example, by making the thickness of the silicon substrate thin, the resistance can be increased. Here, when light is made incident onto the photocathode 22 through the upper frame 2, formed of glass material, photoelectrons are emitted from the photocathode 22 toward the side wall frame 3. The emitted photoelectrons arrive at the electron multiplier section 31 positioned directly below the photocathode 22. Since a potential difference is formed in the longitudinal direction of the silicon substrate 30, the photoelectrons arriving at the electron multiplier section 31 are directed toward the anode 32 side. Grooves, defined by the plurality of the wall portions 311, are formed in the electron multiplier section 31. A photoelectron arriving from the photocathode 22 to the electron multiplier section 31 thus collides with the side walls of the wall portions 311 and the bottom portion 301*a* between the mutually opposing side walls 311 and causes the emission of a plurality of secondary electrons. Cascade multiplication of secondary electrons is successively carried out in the electron multiplier section 31 and $10^5$ to $10^7$ electrons are generated per single electron arriving from the photocathode to the electron multiplier section. The generated secondary electrons arrive at the anode 32 and are taken out as signals from the anode terminal 402.

Figure 5:
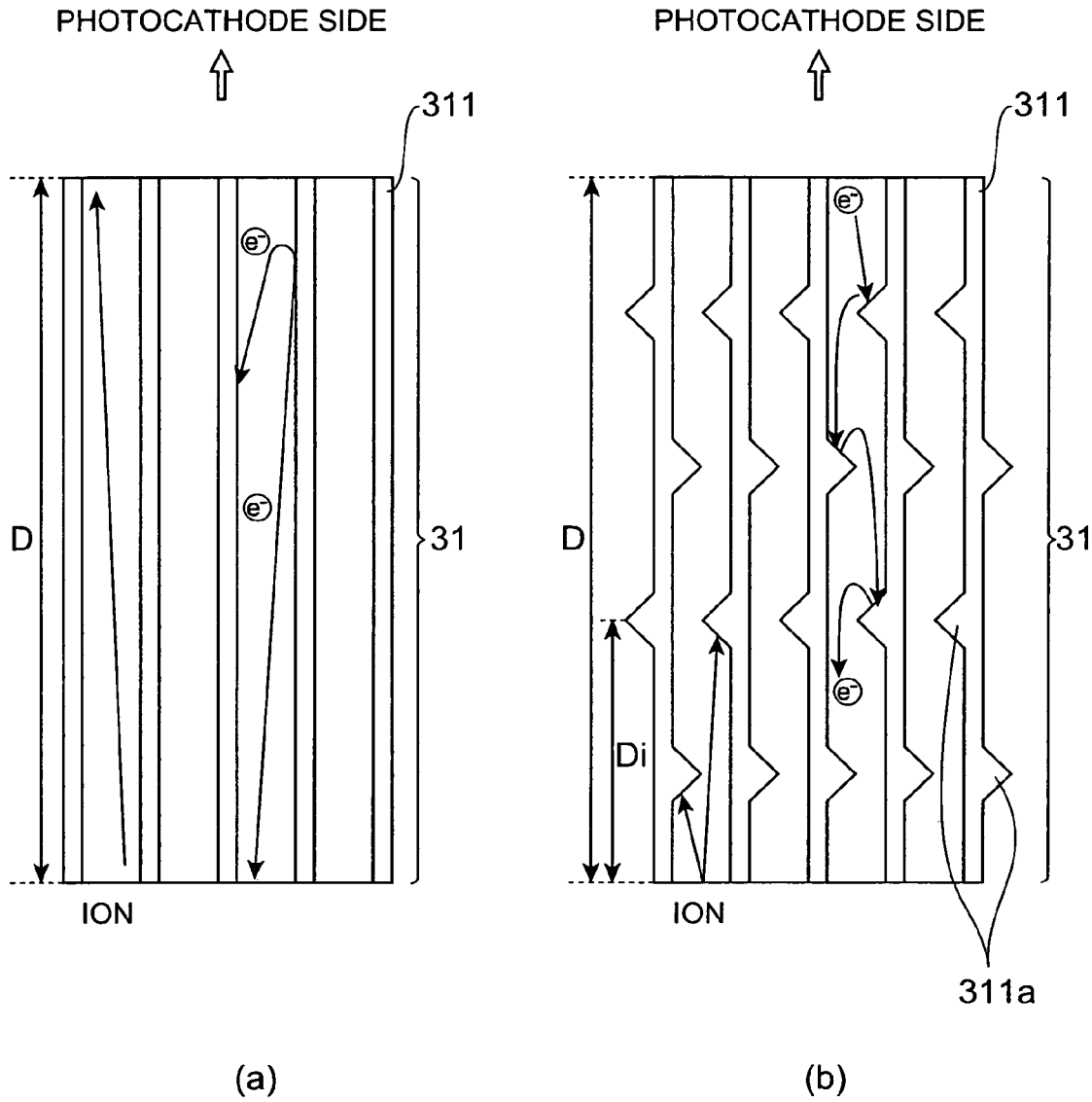
FIG. 5 shows diagrams for explaining functions of protrusions provided in groove portions in the electron multiplier section.

Functions of the protrusions 311*a*, formed on the surfaces of the wall portions 311 that define groove portions, shall now be explained by using FIG. 5.

First, the area (a) of FIG. 5 shows, as a comparative example, groove portions of the electron multiplier section 31 defined by the wall portions 311 that are not provided with protrusions on the surface. In the case of the structure shown in the area (a) of FIG. 5, since the possibility that an electron traveling through a groove portion will reach the anode without colliding with the wall portion 311 is high, the electron multiplication factor may dramatically decrease due to decrease of the number of times of collision with secondary electron emitting surfaces formed on the wall portion surfaces. Also, in a case where a positive ion, generated by an electron colliding with a gas inside the photomultiplier 1*a*, is generated, for example, near an anode side end portion of a groove portion, it travels in the direction opposite the direction of progress of electrons with an energy, corresponding, at the maximum, to the potential difference D between the anode side end portion of the groove portion and a photocathode side end portion. The output current characteristics may thus degrade due to such a positive ion becoming incident on the photocathode 22 or colliding with the wall portion 311 with an energy corresponding to the potential difference and thereby causing the emission of quasi-secondary electrons.

On the other hand, in a structure in which the protrusions 311*a* are formed on the surfaces of the wall portions 311 that define the groove portions of the electron multiplier section 31 as shown in the area (b) of FIG. 5, the above-described issues are resolved and the electron multiplier efficiency can be dramatically improved.

That is, in the arrangement in which the protrusions provided on the surface of one wall portion defining a single groove portion and the protrusions provided on the surface of the other wall portion are alternately positioned along the direction of progress of the electrons that are directed from the photocathode side to the anode side, the probability of reaching the anode 32 without collision with a wall portion is dramatically decreased. The possibility of an electron from the photocathode 22 colliding with at least one of the wall portions (secondary electron emitting surfaces) is thus increased and an adequate electron multiplier efficiency is obtained.

Figure 6:
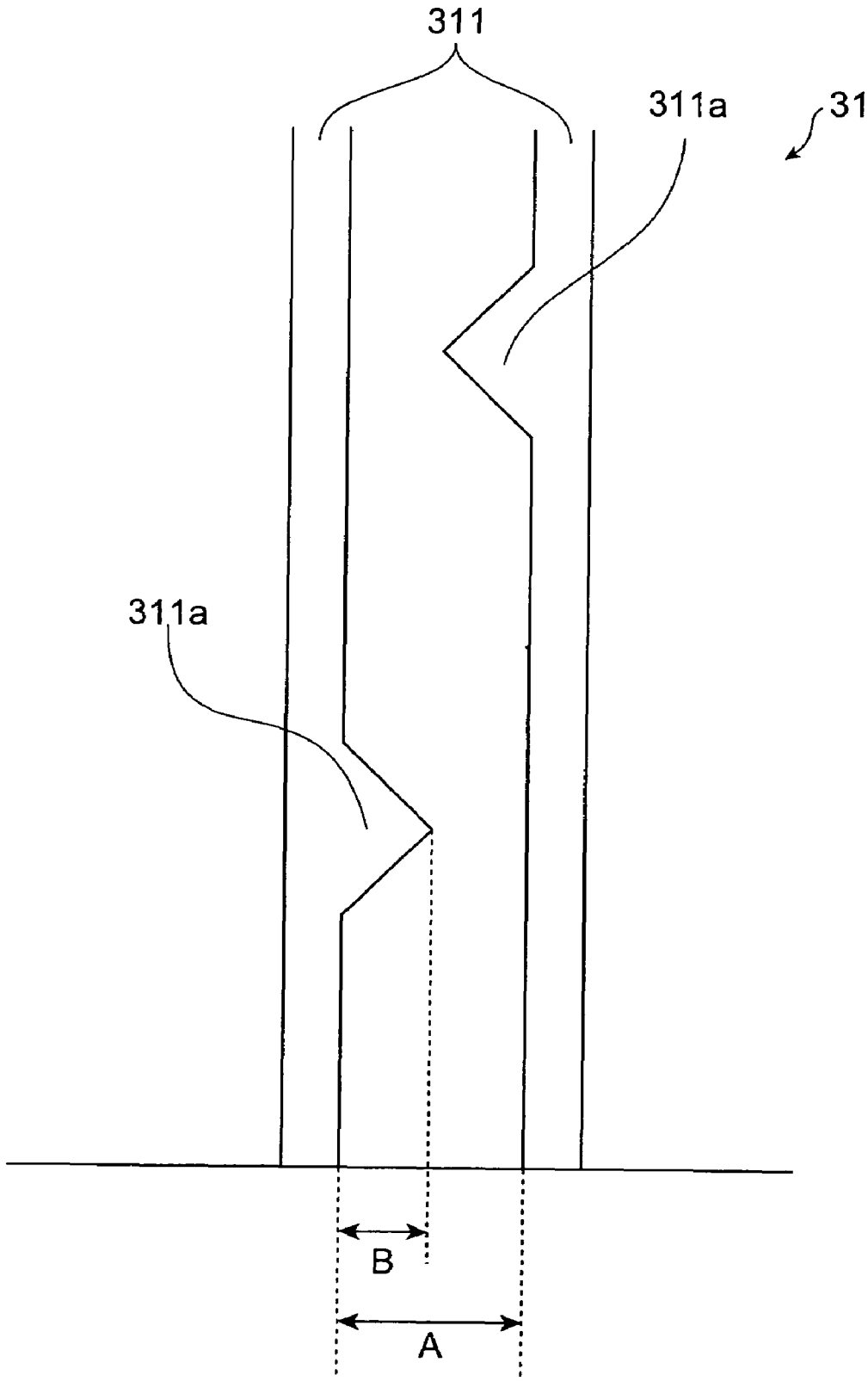
FIG. 6 is a diagram for explaining a relationship between the protrusions provided in a groove portion in the electron multiplier section and wall portions that define the groove portion.

The height B of each protrusion 311*a* preferably satisfies the relationship, B≧A/2, with respect to an interval A between the mutually adjacent wall portions 311 (see FIG. 6). In this case, since it becomes impossible for an electron progressing toward the anode 32 through the groove portion to take a rectilinear path, the electron will collide at least once with one of the pair of wall portions and thereby reliably contribute to the secondary electron multiplication factor.

Though with the above-described embodiment, a transmission type photomultiplier was described, the photomultiplier according to the present invention may be of a reflection type. A reflection type photomultiplier can be obtained, for example, by forming a photocathode on an end portion at the side opposite the anode side end of the electron multiplier section 31. A reflection type photomultiplier can also be obtained by forming an inclined surface at an end portion side at the opposite side of the anode side of the electron multiplier section 31 and forming the photocathode on this inclined surface. With either structure, a reflection type photomultiplier is obtained with the structures of other portions being in the same state as those of the above-described photomultiplier 1*a*.

Also, with the above-described embodiment, the electron multiplier section 31 that is positioned inside the outer casing is integrally formed to and in a state of contacting the silicon substrate 30 that makes up the side wall frame 3. However, in such a state in which the side wall frame 3 and the electron multiplier section 3 are in contact, the electron multiplier section 3 is influenced by external noise through the side wall frame 3 and the detection precision may be lowered thereby. The electron multiplier section 31 and anode 32, which are integrally formed to the side wall frame 3, may thus instead be positioned on the glass substrate 40 (lower frame 4) in a state of being separated by a predetermined distance from the side wall frame 3.

Furthermore in the above-described embodiment, the upper frame 2, which makes up a portion of the outer casing, is comprised of the glass substrate 20, and this glass substrate 20 itself functions as a transmitting window. However, the upper frame 2 may be comprised of a silicon substrate instead. In this case, a transmitting window is formed either on the upper frame 2 or the side wall frame 3. As a method for forming the transmitting window, for example, both surfaces of an SOI (Silicon On Insulator) substrate, with which both surfaces of a sputter glass substrate are sandwiched by silicon substrates, are etched and a portion of the exposed sputter glass substrate may be used as the transmitting window. Or, a column-like or mesh-like pattern of several μm may be formed on a silicon substrate and this portion may be vitrified by thermal oxidation. Or, a silicon substrate at a transmitting window forming region may be etched to be approximately several μm in thickness and vitrified by thermal oxidation. In this case, the silicon substrate may be etched from both surfaces or from just one side.

A method for manufacturing the photomultiplier 1*a* shown in FIG. 1 shall now be explained. To manufacture this photomultiplier, a silicon substrate (the material of the side wall frame 3 of FIG. 2) of 4-inch diameter and two glass substrates (the materials of the upper frame 2 and lower frame 4 of FIG. 2) of the same shape are prepared. The process to be explained below is then applied to each minute region (for example, of a few millimeters square) of these substrates. When the process explained below is completed, the substrates are separated according to each region to complete the photomultipliers. This processing method shall now be explained by using FIGS. 7 and 8.

Figure 7:
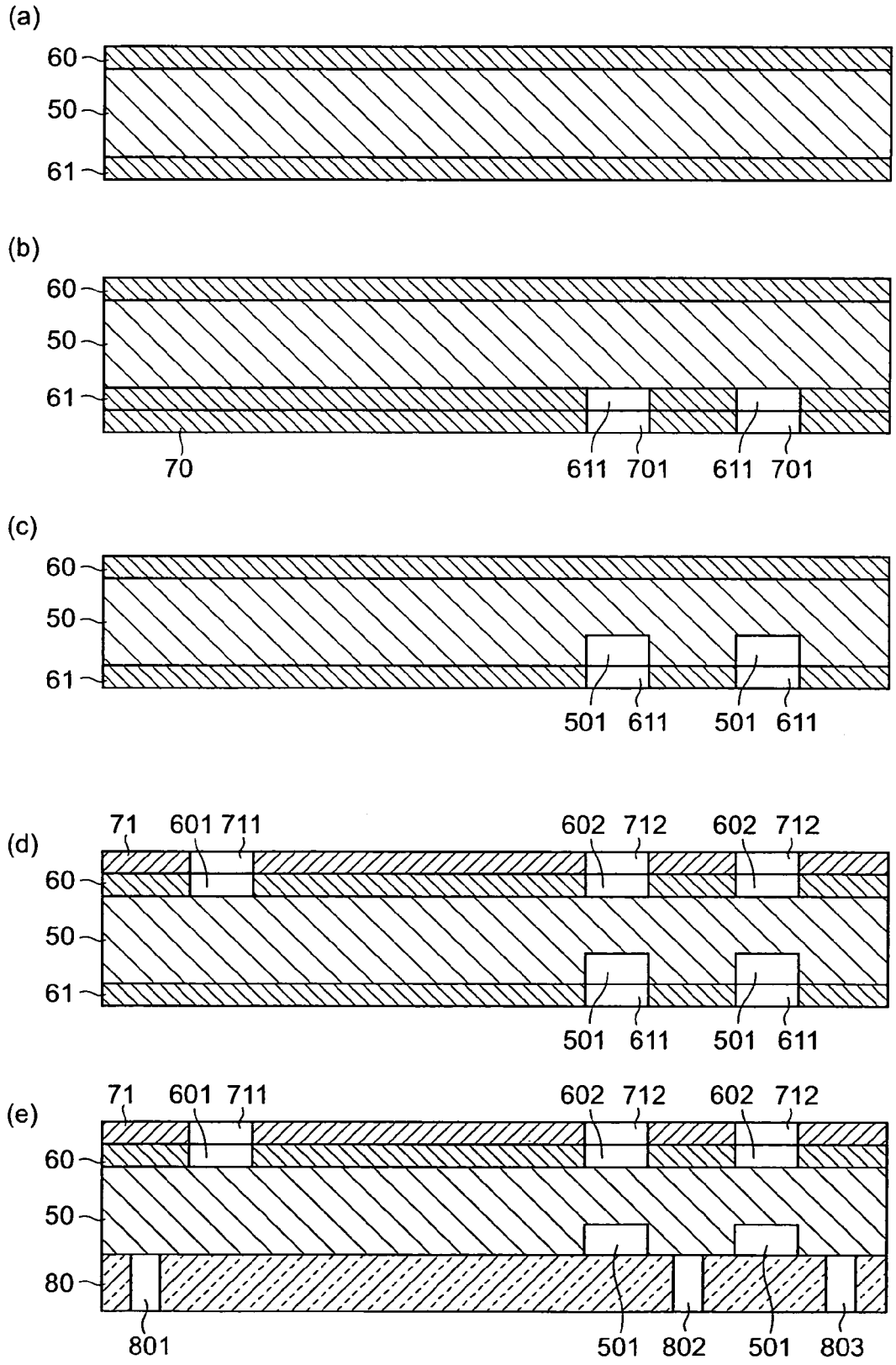
FIG. 7 shows diagrams for explaining a process of manufacturing the photomultiplier shown in FIG. 1 (Part 1)

First, as shown in the area (a) of FIG. 7, the silicon substrate 50 (corresponding to the side wall frame 3) of a thickness of 0.3 mm and a specific resistance of 30 kΩ·cm is prepared. A silicon thermal oxide film 60 and a silicon thermal oxide film 61 are formed on the respective surfaces of the silicon substrate 50. The silicon thermal oxide film 60 and the silicon thermal oxide film 61 function as masks in a DEEP-RIE (Reactive Ion Etching) process. Then as shown in the area (b) of FIG. 7, a resist film 70 is formed on the rear surface of the silicon substrate 50. In the resist film 70 are formed removed portions 701 corresponding to the gaps between the pass-through portion 302 and the anode 32. When the silicon thermal oxide film 61 is etched in this state, removed portions 611, corresponding to the gaps between the pass-through portion 302 and the anode 32 shown in FIG. 2, are formed.

After the resist film 70 is removed from the state shown in the area (b) of FIG. 7, a DEEP-RIE process is performed. As shown in the area (c) of FIG. 7, gaps 501, corresponding to the gaps between the pass-through portion 302 and the anode 32 of FIG. 2, are formed in the silicon substrate 50. Then as shown in the area (d) of FIG. 7, a resist film 71 is formed on the top surface side of the silicon substrate 50. In the resist film 71 are formed a removed portion 711, corresponding to the gap between the wall portions 311 and the recessed portion 301 of FIG. 2, the removed portions 712, corresponding to the gaps between the pass-through portion 302 and the anode 32 of FIG. 2, and removed portions (not shown), corresponding to the grooves between the wall portions 311 of FIG. 2. When the silicon thermal oxide film 60 is etched in this state, the removed portion 601, corresponding to the gap between the wall portions 311 and the recessed portion 301 of FIG. 2, the removed portions 602, corresponding to the gaps between the pass-through portion 302 and the anode 32 of FIG. 2, and the removed portions (not shown), corresponding to the grooves between the wall portions 311 of FIG. 2, are formed.

After the silicon thermal oxide film 61 is removed from the state shown in the area (d) of FIG. 7, a glass substrate 80 (corresponding to the lower frame 4) is anodic bonded to the rear surface side of the silicon substrate 50 (see the area (e) of FIG. 7). A hole 801, corresponding to the hole 401 of FIG. 2, a hole 802, corresponding to the hole 402 of FIG. 2, and a hole 803, corresponding to the hole 403 of FIG. 2, are formed in advance in this glass substrate 80. A DEEP-RIE process is then performed on the top surface side of the silicon substrate 50. The resist film 71 functions as a mask material in the DEEP-RIE process and enables processing of a high aspect ratio. After the DEEP-RIE process, the resist film 71 and the silicon thermal oxide film 61 are removed. As shown in the area (a) of FIG. 8, by a pass-through portion that reaches the glass substrate 80 being formed at a portion at which a gap 501 is formed from the rear surface in advance, an insular portion 52, corresponding to the anode 32 of FIG. 2, is formed. The insular portion 52, corresponding to the anode 32, is fixed to the glass substrate 80 by anodic bonding. Also in the process of this DEEP-RIE process, the groove portions 51, corresponding to the grooves between the wall portions 311 of FIG. 2, and the recessed portion 503, corresponding to the gap between the wall portions 311 and the recessed portion 301 of FIG. 2, are formed. Here, secondary electron emitting surfaces are formed on the side walls of the groove portions 51 and on the bottom portion 301*a*.

Figure 8:
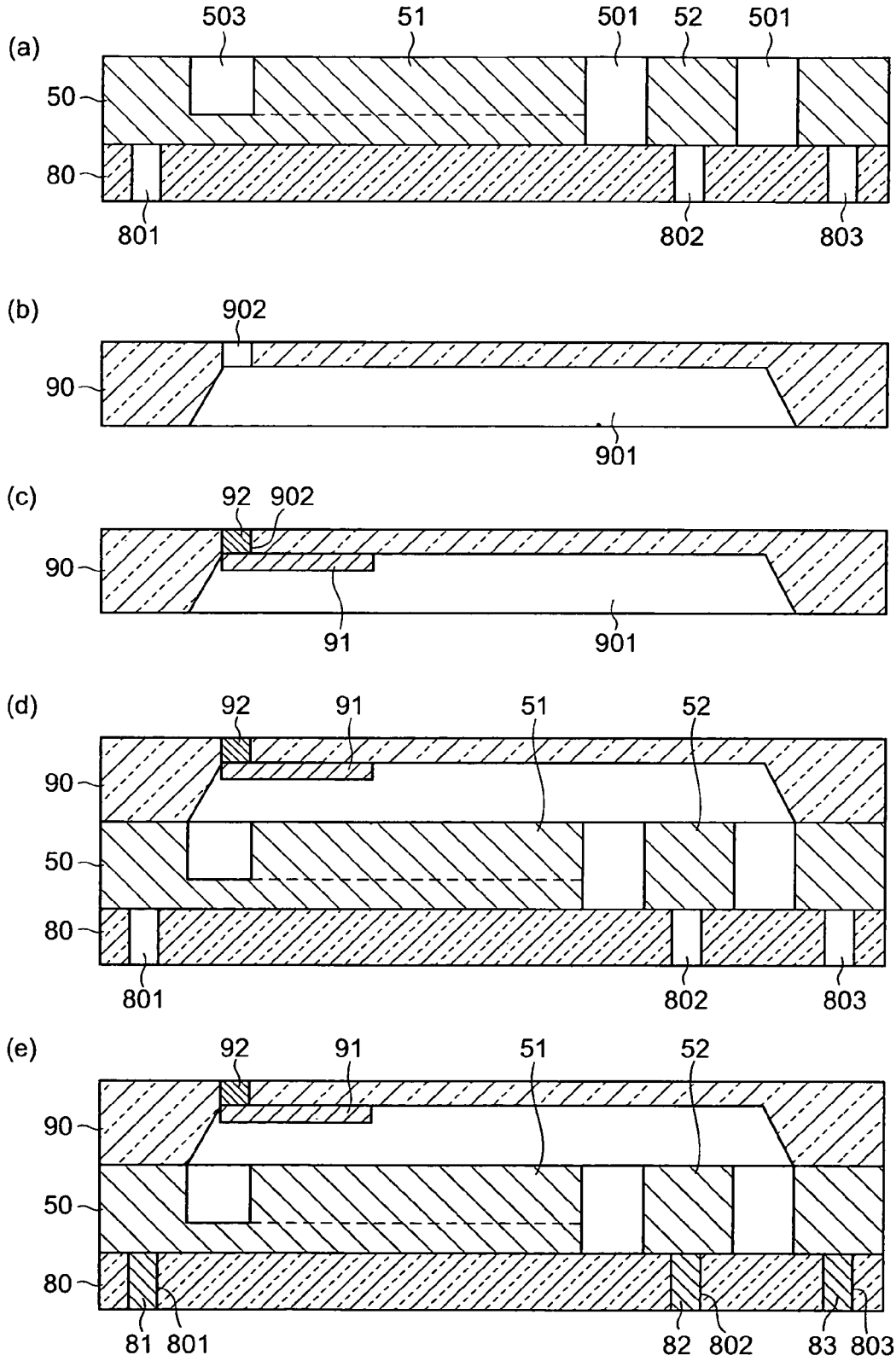
FIG. 8 shows diagrams for explaining the process of manufacturing the photomultiplier shown in FIG. 1 (Part 2)

Next, a glass substrate 90, corresponding to the upper frame 2, is prepared as shown in the area (b) of FIG. 8. The glass substrate 90 has a recessed portion 901 (corresponding to the recessed portion 201 of FIG. 2) formed by counterboring, and a hole 902 (corresponding to the hole 202 of FIG. 2)

is formed so as to reach the recessed portion 901 from a top surface of the glass substrate 90. As shown in the area (c) of FIG. 8, the photocathode terminal 92, corresponding to the photocathode terminal 21 of FIG. 2, is inserted and fixed in the hole 902 and a photocathode 91 is formed in the recessed portion 901.

The silicon substrate 50 and the glass substrate 80, for which processing up to the state shown in the area (a) of FIG. 8 has been completed, and the glass substrate 90, for which processing up to the state shown in the area (c) of FIG. 8 has been completed, are then bonded in a vacuum sealed state by anodic bonding or diffusion bonding as shown in the area (d) of FIG. 8. Thereafter, by the photocathode side terminal 81, corresponding to the photocathode side terminal 41 of FIG. 2, being inserted and fixed in the hole 801, the anode terminal 82, corresponding to the anode terminal 42 of FIG. 2, being inserted and fixed in the hole 802, and the anode side terminal 83, corresponding to the anode side terminal 43 of FIG. 2, being inserted and fixed in the hole 803, the state shown in the area (e) of FIG. 8 is attained. By thereafter cutting out in chip units, photomultipliers with the structure shown in FIGS. 1 and 2 are obtained.

Figure 9:
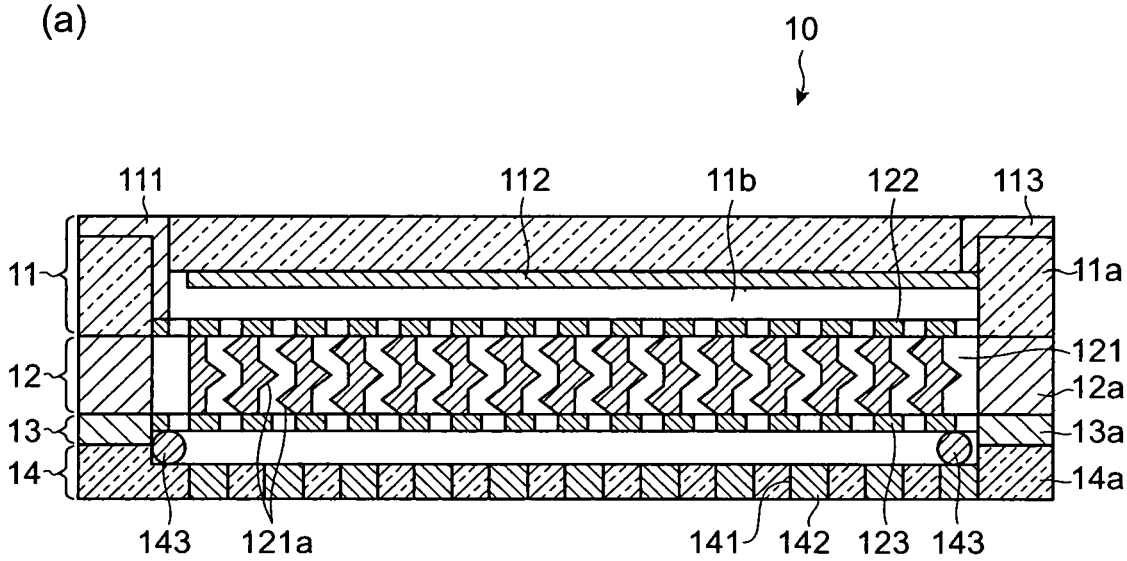
FIG. 9 shows diagrams of another structure of a photomultiplier according to the present invention.
Figure 9:
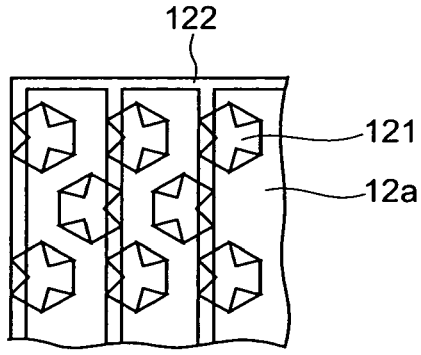

FIG. 9 shows diagrams of another structure of a photomultiplier according to the present invention. Sectional structures of a photomultiplier 10 are shown in FIG. 9. As shown in the area (a) of FIG. 9, the photomultiplier 10 is arranged by an upper frame 11, a side wall frame 12 (silicon substrate), a first lower frame 13 (glass member), and a second lower frame (substrate) being anodic bonded respectively. The upper frame 11 is comprised of a glass material and has a recessed portion 11*b* formed on its surface opposing the side wall frame 12. A photocathode 112 is substantially formed across the entire surface of the bottom portion of recessed portion 11*b*. A photocathode electrode 113, which applies a potential to the photocathode 112, and the top surface electrode terminal 111, which contacts a surface electrode to be described later, are respectively positioned at one end and the other end of the recessed portion 11*b*.

The side wall frame 12 has a plurality of holes 121 formed parallel to a tube axis direction in a silicon substrate 12*a*. Protrusions 121*a* for making electrodes collide are provided in the inner surfaces of these holes 121, and secondary electron emitting surfaces are formed on the inner surfaces of the holes 121, including the protrusions 121*a*. Also, a top surface electrode 122 and a rear surface electrode 123 are disposed near openings at the respective ends of the holes 121. The positional relationship of the holes 121 and the top surface electrode 122 is shown in the area (b) of FIG. 9. As shown in the area (b) of FIG. 9, the top surface electrode 122 is positioned so as to face the holes 121. The same applies to the rear surface electrode 123 as well. The top surface electrode 122 is in contact with the top surface electrode terminal 111, and the rear surface electrode 123 is in contact with a rear surface electrode terminal 143. A potential in the axial direction of the holes 121 is thus generated in the side wall frame 12, and photoelectrons, generated from the photocathode 112, progress inside the holes 121 in the downward direction in the figure.

The first lower frame 13 is a member for the connecting side wall frame 12 and the second lower frame 14 and is anodic bonded (or may be diffusion bonded) to both the side wall frame 12 and the second lower frame 14.

The second lower frame 14 is arranged from a silicon substrate 14*a* provided with a plurality of the holes 141. An anode 142 is inserted and fixed in each of the holes 141.

In the photomultiplier 10, shown in FIG. 9, light that is made incident from the upper side of the figure is transmitted through the glass substrate of the upper frame 11 and made incident on the photocathode 112. In accordance to this incident light, photoelectrons are emitted from the photocathode 112 toward side wall frame 12. The emitted-photoelectrons enter the holes 121 of the first lower frame 13. The photoelectrons that enter the holes 121 collide with the inner walls of the holes 121 to generate secondary electrons, and the generated secondary electrons are emitted toward the second lower frame 14. The emitted secondary electrons are taken out as signals by the anode 142.

Figure 10:
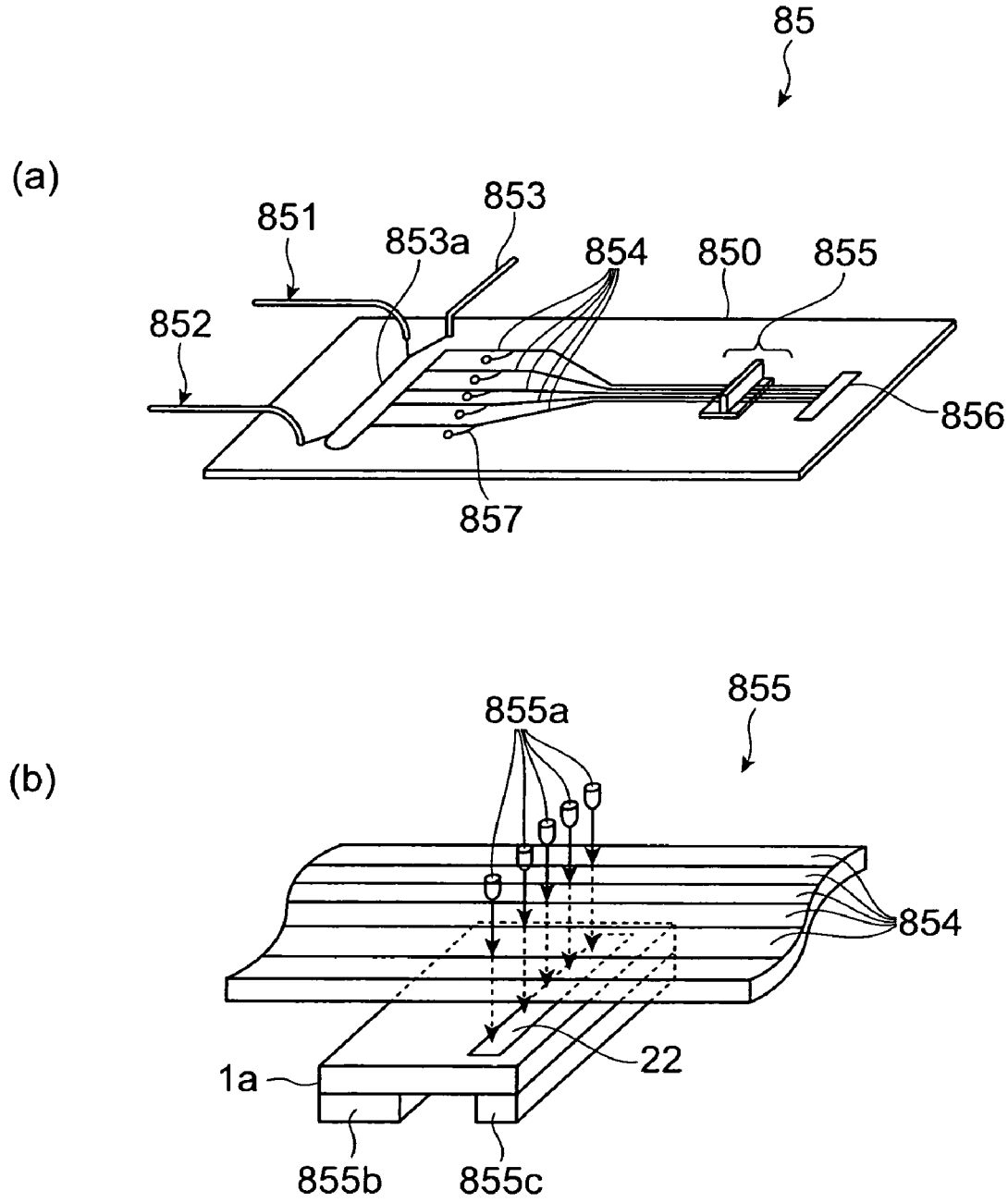
FIG. 10 shows diagrams of an arrangement of a detection module to which the photomultiplier according to the present invention is applied.

An optical module, to which the photomultiplier 1*a* having the above-described structure is applied, shall now be explained. The area (a) of FIG. 10 shows a diagram of a structure of an analysis module to which the photomultiplier la is applied. The analysis module 85 includes a glass plate 850, a gas introducing tube 851, a gas exhausting tube 852, a solvent introducing tube 853, reagent mixing and reacting paths 854, a detecting unit 855, a waste liquid well 856, and a reagent path 857. The gas introducing tube 851 and the gas exhausting tube 852 are provided to introduce and exhaust a gas to be analyzed into and out of the analysis module 85. A gas that is introduced into the gas introducing tube 851 passes through an extracting path 853*a*, formed on the glass plate 850, and is exhausted to the exterior from the gas exhausting tube 852. Thus when specific substances of interest (for example, endocrine disrupters or microparticles) are present in the introduced gas, the substances can be extracted into a solvent by introducing the solvent from the solvent introducing tube 853 and passing the solvent through the extracting path 853*a*.

The solvent that has passed through the extracting path 853*a* is introduced into the reagent mixing and reacting paths 854 while containing the extracted substances of interest. There are a plurality of reagent mixing and reacting paths 854, and by corresponding reagents being introduced into the respective paths from the reagent paths 857, the reagents are mixed with the solvent. The solvent to which reagents have been mixed proceed toward the detecting unit 855 along the reagent mixing and reacting paths 854 while reactions take place. The solvent for which the detection of the substances of interest has been completed at the detecting unit 855 is discarded in the waste liquid well 856.

An arrangement of the detecting unit 855 shall now be described with reference to the area (b) of FIG. 10. The detecting unit 855 includes a light emitting diode array 855*a*, a photomultiplier 1*a*, a power supply 855*c*, and an output circuit 855*b*. The light emitting diode array 855*a* is provided with a plurality of light emitting diodes in correspondence to each of reagent mixing and reacting paths 854 of the glass plate 850. Excitation lights (indicated by the solid line arrows in the figure), emitted from the light emitting diode array 855*a*, are guided to the reagent mixing and reacting paths 854. The solvent that may contain substances of interest flows through the reagent mixing and reacting paths 854, and after a substance of interest and the reagent reacts in a reagent mixing and reacting path 854, excitation light is illuminated onto a corresponding reagent mixing and reacting path 854 at the detecting unit 855 and fluorescence light or transmitted light arrives at the photomultiplier 1*a*. This fluorescence light or transmitted light is illuminated onto the photocathode 22 of the photoelectric tube 1*a*.

As described above, since an electron multiplier section, having a plurality of grooves (for example, corresponding to 20 channels), is provided in the photomultiplier 1*a*, it can be detected at which position (which reagent mixing and reacting path 854) a change of florescence light or transmitted light has taken place. The detection result is outputted from the output circuit 855*b*. The power supply 855*c* is a power supply for driving the photomultiplier 1*a*. A thin glass plate (not shown) is positioned above the glass plate 850 and covers the extracting path 853*a*, reagent mixing and reacting paths 854, reagent paths 857 (with the exception of reagent injecting portions) and other portions besides the waste liquid well 856, the reagent injecting portions of the reagent paths 857, and the points of contact of the gas introducing tube 851, gas exhausting tube 852, and solvent introducing tube 853 with the glass plate 850.

As described above, in accordance with the present invention, by protrusions 311*a* of desired height being provided on surfaces of the wall portions 311 that define groove portions of the photomultiplier 31, the electron multiplier efficiency can be dramatically improved.

Since the electron multiplier section 31 has grooves formed by fine processing of the silicon substrate 30*a* and the silicon substrate 30*a*is anodic bonded or diffusion bonded to the glass substrate 40*a*, there are no vibrating portions. The photomultiplier according to the present invention is thus excellent in vibration resistance and impact resistance.

Since the anode 32 is anodic bonded or diffusion bonded to the glass substrate 40*a*, there is no metal mist arising from welding. The photomultipliers according to the respective embodiments are thus improved in electrical stability, vibration resistance, and impact resistance. Since the anode 32 is anodic bonded or diffusion bonded to the glass substrate 40*a* across its entire lower surface, the anode 32 does not vibrate under impact or vibration. These photomultipliers are thus improved in vibration resistance and impact resistance.

Also in manufacturing the photomultipliers, since the internal structures do not need to be assembled and handling is simple, the working time is short. Since the outer casing (vacuum container), arranged from the upper frame 2, side wall frame 3, and lower frame 4, and the internal structures are integrally arranged, compactness can be readily realized. Since there are no individual parts in the interior, neither electrical nor mechanical bonding is necessary.

Since a special member is not required for the sealing of the outer casing, arranged from the upper frame 2, side wall frame 3, and lower frame 4, sealing at the size of a wafer as in the photomultiplier according to this invention is possible. Since a plurality of photomultipliers are diced after sealing, work is simple and manufacture can be inexpensively carried out.

Due to sealing by anodic bonding or diffusion bonding, foreign matter does not arise. The photomultiplier is thus improved in electrical stability, vibration resistance, and impact resistance.

At the electron multiplier section 31, electrons are cascade multiplied while colliding with the side walls of the plurality of grooves formed by wall portions 311. Since the structure is thus simple and a large number of parts are not required, compactness can be realized readily.

In the analysis module 85 to which the photomultiplier with the above-described structure is applied, the detection of minute particles is enabled. Also, processes from extraction to reaction and detection can be continuously performed.

From the invention thus described, it will be obvious that the embodiments of the invention may be varied in many ways. Such variations are not to be regarded as a departure from the spirit and scope of the invention, and all such modifications as would be obvious to one skilled in the art are intended for inclusion within the scope of the following claims.

INDUSTRIAL APPLICABILITY

The photomultiplier according to the present invention can be applied to various fields requiring the detection of weak light.

The invention claimed is:

1. A photomultiplier comprising:

an outer casing whose interior is maintained in a vacuum state;

a photocathode accommodated in said outer casing, said photocathode emitting electrons into the interior of said outer casing in accordance with light taken in via said outer casing;

an electron multiplier section accommodated in said outer casing, said electron multiplier section having: a base which has a main surface facing said photocathode such that the electrons from said photocathode directly reach; and a plurality of wall portions for guiding, on the main surface of said base, the reached electrons in a predetermined direction, each of said wall portions extending along the predetermined direction while being in direct contact with the main surface of said base; and an anode accommodated in said outer casing, said anode taking out, from among electrons resulting from cascade multiplication at said electron multiplier section, reached electrons as signals, wherein one or more protrusions, each having a secondary electron emitting surface formed on the surface thereof to perform cascade multiplication of the electrons from said photocathode, are provided on the respective surfaces of the adjacent wall portions which face each other, and wherein an interval between the adjacent wall portions which face each other seesaws along a direction from said photocathode to said anode.

2. A photomultiplier comprising:

an outer casing whose interior is maintained in a vacuum state;

a photocathode accommodated in said outer casing, said photocathode emitting electrons into the interior of said outer casing in accordance with light taken in via said outer casing;

an electron multiplier section accommodated in said outer casing, said electron multiplier section having groove portions each extending along a propagation direction of the electrons; and an anode accommodated in said outer casing, said anode taking out, from among electrons resulting from cascade multiplication at said electron multiplier section, reached electrons as signals, wherein one or more protrusions, each having a secondary electron emitting surface formed on the surface thereof to perform cascade multiplication of the photoelectrons from said photocathode, are provided on the respective surfaces of each pair of wall portions that define the groove portions, and wherein a height B of each protrusion provided on the surface of the one wall portion among said each pair of wall portions satisfies the following relationship with respect to an interval A between said each pair of wall portions: $B \geqq A/2$.

3. A photomultiplier according to claim 2, wherein said protrusions provided on the surface of one wall portion of said each pair of wall portions and said protrusions provided on the surface of the other wall portion of said each pair of wall portions are alternately positioned along the propagation direction of the electrons.

4. A photomultiplier comprising:

an outer casing whose interior is maintained in a vacuum state, said outer casing being constituted by a plurality of glass frames and a plurality of silicon frames which are alternately laminated and are anodic bonded to each other;

a photocathode accommodated in said outer casing, said photocathode emitting electrons into the interior of said outer casing in accordance with light taken in via said outer casing;

an electron multiplier section accommodated in said outer casing, said electron multiplier section having through holes each extending along a propagation direction of the electrons, the through holes being directly provided in one of said plurality of silicon frames; and an anode accommodated in said outer casing and directly provided in the other one of said plurality of silicon frames, said anode taking out, from among electrons resulting from cascade multiplication at said electron multiplier section, reached electrons as signals, wherein one or more protrusions, each having a secondary electron emitting surface formed on the surface thereof to perform cascade multiplication of the photoelectrons from said photocathode, are provided on inner wall surfaces of the through holes, and wherein each sectional area of the through holes, defined by a plane orthogonal to a direction from said photocathode to said anode, seesaws along the direction from said photocathode to said anode.

5. A photomultiplier according to claim 4, wherein said protrusions, provided on the surfaces of the wall portions that define the through holes, are positioned at mutually shifted positions as observed in a propagation direction of the electrons.

* * * * *